US011143185B2

(12) United States Patent
Ichise et al.

(10) Patent No.: US 11,143,185 B2
(45) Date of Patent: Oct. 12, 2021

(54) SCROLL COMPRESSOR

(71) Applicant: MITSUBISHI HEAVY INDUSTRIES THERMAL SYSTEMS, LTD., Tokyo (JP)

(72) Inventors: Yuki Ichise, Tokyo (JP); Ichiro Yogo, Tokyo (JP); Akinori Yoshioka, Tokyo (JP); Manabu Suzuki, Tokyo (JP); Takeshi Hirano, Tokyo (JP)

(73) Assignee: MITSUBISHI HEAVY INDUSTRIES THERMAL SYSTEMS, LTD., Tokyo (JP)

( * ) Notice: Subject to any disclaimer, the term of this patent is extended or adjusted under 35 U.S.C. 154(b) by 101 days.

(21) Appl. No.: 16/640,480

(22) PCT Filed: Jul. 3, 2018

(86) PCT No.: PCT/JP2018/025144
§ 371 (c)(1),
(2) Date: Feb. 20, 2020

(87) PCT Pub. No.: WO2019/039095
PCT Pub. Date: Feb. 28, 2019

(65) Prior Publication Data

US 2020/0173443 A1 Jun. 4, 2020

(30) Foreign Application Priority Data

Aug. 25, 2017 (JP) ..... JP2017-162570

(51) Int. Cl.
*F04C 18/02* (2006.01)
*F04C 29/02* (2006.01)

(52) U.S. Cl.
CPC ..... *F04C 18/0215* (2013.01); *F04C 29/026* (2013.01); *F04C 2240/40* (2013.01);
(Continued)

(58) Field of Classification Search
CPC ..... F04C 18/0215; F04C 2240/40; F04C 2240/50; F04C 2240/56; F04C 2240/801
See application file for complete search history.

(56) References Cited

U.S. PATENT DOCUMENTS

2004/0124731 A1* 7/2004 Kimura ..... H02K 7/14 310/216.044
2004/0197209 A1* 10/2004 Kitaura ..... F04C 18/0215 417/366

(Continued)

FOREIGN PATENT DOCUMENTS

JP 63117186 A * 5/1988
JP 1-290991 A 11/1989

(Continued)

OTHER PUBLICATIONS

International Search Report for International Application No. PCT/JP2018/025144, dated Sep. 18, 2018, with English translation.

(Continued)

*Primary Examiner* — Mark A Laurenzi
*Assistant Examiner* — Xiaoting Hu
(74) *Attorney, Agent, or Firm* — Birch, Stewart, Kolasch & Birch, LLP

(57) ABSTRACT

A scroll compressor includes a flow path that is disposed in a portion of a bearing holder, which corresponds to each formation position of a plurality of stator groove portions, and that penetrates the bearing holder in an axial direction, a first recess portion (72) disposed in a portion of a thrust bearing, which faces the flow path, and recessed from one side in the axial direction to the other side in the axial direction, and a first groove portion (74) disposed in an outer peripheral portion of the first recess portion (72), extending from a bottom surface (72*a*) of the recess portion (72) to a surface located on a side opposite to a surface having the (Continued)

first recess portion (72) formed thereon, and communicating with the first recess portion (72) in the axial direction.

5 Claims, 9 Drawing Sheets

(52) U.S. Cl.
CPC ..... *F04C 2240/50* (2013.01); *F04C 2240/60* (2013.01); *F04C 2240/801* (2013.01)

(56) References Cited

U.S. PATENT DOCUMENTS

| | | | |
|---|---|---|---|
| 2009/0148314 | A1 | 6/2009 | Koitabashi et al. |
| 2015/0303762 | A1 | 10/2015 | Hagita et al. |

FOREIGN PATENT DOCUMENTS

| | | | | | |
|---|---|---|---|---|---|
| JP | 3-246388 | A | | 11/1991 | |
| JP | 8-61255 | A | | 3/1996 | |
| JP | 8-105392 | A | | 4/1996 | |
| JP | 2014-88852 | A | | 5/2014 | |
| JP | 5518169 | B1 | | 6/2014 | |
| JP | 2016-77063 | A | | 5/2016 | |
| JP | 2016151264 | A | * | 8/2016 | ..... F04C 18/0215 |
| WO | WO 2006/106753 | A1 | | 10/2006 | |
| WO | WO-2007123015 | A1 | * | 11/2007 | ..... F04C 18/0215 |

OTHER PUBLICATIONS

Written Opinion of the International Searching Authority for International Applicaiton No. PCT/JP2018/025144, dated Sep. 18, 2018, with English translation.

* cited by examiner

SCROLL COMPRESSOR

TECHNICAL FIELD

The present invention relates to a scroll compressor.

Priority is claimed on Japanese Patent Application No. 2017-162570, filed on Aug. 25, 2017, the content of which is incorporated herein by reference.

BACKGROUND ART

A scroll compressor has a casing, a motor, and a scroll compression unit. The motor and the scroll compression unit are housed in a space formed inside the casing (for example, refer to Patent Document 1).

Patent Document 1 discloses a scroll compressor including a casing, a thrust bearing, a scroll compression unit including a turning scroll and a fixed scroll, and a motor.

The casing has a cylindrical casing body and a bearing holder that protrudes inward in a radial direction from an inner peripheral surface of the casing body. The bearing holder divides a space formed inside the casing body into a motor housing space and a compression unit housing space in an axial direction.

The bearing holder has a flow path for guiding a lubricant to be supplied into the motor housing space and a fluid to be compressed by the compression unit, from the motor housing space to the compression unit housing space.

The thrust bearing is disposed on the other side surface (surface located on the compression unit housing space side) of the bearing holder in the axial direction. The thrust bearing has a function to receive a thrust-direction force generated when the turning scroll is rotated.

CITATION LIST

Patent Document

Patent Document 1: Japanese Patent Publication No. 5518169

DISCLOSURE OF INVENTION

Technical Problem

However, according to the scroll compressor disclosed in Patent Document 1 described above, when the fluid supplied into the motor housing space moves to the compression unit housing space via the thrust bearing, there is a problem in that a considerable pressure loss occurs.

Therefore, the present invention aims to provide a scroll compressor which can properly supply a lubricant and can reduce a pressure loss of a fluid (working fluid) when the fluid passes through a thrust bearing.

Solution to Problem

According to an aspect of the present invention, in order to solve the above-described problem, there is provided a scroll compressor including: a casing having a casing body in which a housing space having a columnar shape around an axis is formed, and a bearing holder having an annular shape by protruding inward in a radial direction from an inside of the casing body and which is formed so as to divide the housing space into a motor housing space located on one side in an axial direction and a compression unit housing space located on the other side in the axial direction; a rotary shaft that is located to extend in the axial direction in the housing space, and that is rotatable around the axis; a motor that is located in the motor housing space, and having a stator having an annular shape formed around the axis and having an outer peripheral surface fixed to an inner peripheral surface of the casing body, and a rotor located inside the stator and disposed on an outer peripheral surface of the rotary shaft; a scroll compression unit that is located inside the compression unit housing space, and which is configured to compress a fluid flowing from the motor housing space to the compression unit housing space; a first radial bearing that is fixed to an inner peripheral surface of the bearing holder, and rotatably supporting the rotary shaft; and a thrust bearing having an annular shape formed around the axis, that is fixed to a surface of the bearing holder facing the other side in the axial direction, and supporting the scroll compression unit in the axial direction. The outer peripheral surface of the stator has a stator groove portion which extends from one end to the other end of the stator in the axial direction. A plurality of the stator groove portions are located at an interval in a circumferential direction of the stator. In the bearing holder, portions corresponding to formation positions of the plurality of stator groove portions each have a flow path penetrating the bearing holder in the axial direction. In the thrust bearing, a portion facing the flow path has a first recess portion recessed from one side in the axial direction to the other side in the axial direction. An outer peripheral portion of the first recess portion has a first groove portion which extends from a bottom surface of the first recess portion to a surface located on a side opposite to a surface having the first recess portion formed thereon in the axial direction and communicates with the first recess portion.

In the bearing holder, the portion corresponding to the formation position of the plurality of stator groove portions has each flow path penetrating the bearing holder in the axial direction. In this manner, the fluid and the lubricant which pass through the stator groove portion are likely to be guided to the flow path. In this manner, the lubricant can be properly supplied, and a pressure loss of the fluid (working fluid) can be reduced when the fluid passes through the thrust bearing.

In addition, in the thrust bearing, the portion facing the flow path has the first recess portion recessed from one side in the axial direction to the other side in the axial direction. In this manner, the fluid and the lubricant which pass through the flow path can be guided into and retained in the first recess portion.

Furthermore, the outer peripheral portion of the first recess portion has the first groove portion which communicates with the first recess portion by extending from the bottom surface of the first recess portion to the surface located on the side opposite to the surface having the first recess portion formed thereon in the axial direction. In this manner, the pressure loss of the fluid can be reduced when the fluid passes through the thrust bearing.

In addition, the thrust bearing has the first recess portion. In this manner, without increasing a cross section of the flow path of the first groove portion, the pressure loss of the fluid can be reduced when the fluid passes through the thrust bearing.

In addition, in the scroll compressor according to the aspect of the present invention, the thrust bearing may have a second recess portion disposed inside the first recess portion, communicating with the first recess portion, and extending to an inner peripheral surface of the thrust bearing.

The second recess portion configured in this way is provided. Accordingly, the lubricant retained inside the first recess portion can be supplied to the bearing (for example, the first radial bearing) located inside in the radial direction.

In addition, in the scroll compressor according to the aspect of the present invention, a width of the second recess portion in a circumferential direction may be narrower than a width of the first recess portion in the circumferential direction.

For example, if the width of the second recess portion in the circumferential direction is wider than the width of the first recess portion in the circumferential direction, a large amount of the fluid and the lubricant is supplied inward in the radial direction of the thrust bearing. For this reason, the supply amount of the fluid and the lubricant to the scroll compression unit may decrease, thereby causing a possibility that compression efficiency may be degraded in the scroll compression unit.

On the other hand, the width of the second recess portion in the circumferential direction is made narrower than the width of the first recess portion in the circumferential direction. In this manner, the lubricant is supplied inward in the radial direction of the thrust bearing, and moreover, the compression efficiency can be improved in the scroll compression unit.

In addition, the scroll compressor according to the aspect of the present invention may include a thrust plate disposed between the bearing holder and the scroll compression unit in the axial direction. In an outer peripheral portion of the thrust plate, a portion facing the first groove portion may have a second groove portion extending from one surface to the other surface, which is located in the axial direction.

The second groove portion configured in this way is provided. Accordingly, the pressure loss of the fluid can be reduced when the fluid passes through the thrust plate.

In addition, the scroll compressor according to the aspect of the present invention may include an oil separator disposed in the casing. A lower portion of the thrust plate may have a lubricant supply groove portion which guides a lubricant supplied from the oil separator to the thrust bearing. A lower portion of the thrust bearing facing the lubricant supply groove portion may have an inclined groove portion which guides the lubricant to flow inward in the radial direction.

According to this configuration, the lubricant supplied to the lubricant supply groove portion from the oil separator can be supplied to the bearing located inside in the radial direction of the thrust bearing via the inclined groove portion.

In addition, in the scroll compressor according to the aspect of the present invention, the rotary shaft may have an eccentric shaft portion extending to the compression unit housing space. The scroll compressor may further include a fixed scroll fixed to an inner peripheral surface of the casing, a turning scroll located between the fixed scroll and the eccentric shaft portion, extending in the axial direction, and including a boss portion surrounding the eccentric shaft portion, a drive bush disposed on an outer peripheral surface of the eccentric shaft portion, and partially located inside the boss portion, and a second radial bearing disposed between the drive bush and the boss portion.

According to this configuration, the turning scroll can turn when the rotary shaft is rotated. In addition, the lubricant can be supplied to the second radial bearing via the second recess portion or the second recess portion and the inclined groove portion.

Advantageous Effects of Invention

According to the present invention, the lubricant can be properly supplied, and the pressure loss of the fluid (working fluid) can be reduced when the fluid passes through the thrust bearing.

BEST MODE FOR CARRYING OUT THE INVENTION

Hereinafter, an embodiment to which the present invention is applied will be described in detail with reference to the drawings.

Embodiment

Figure 1:
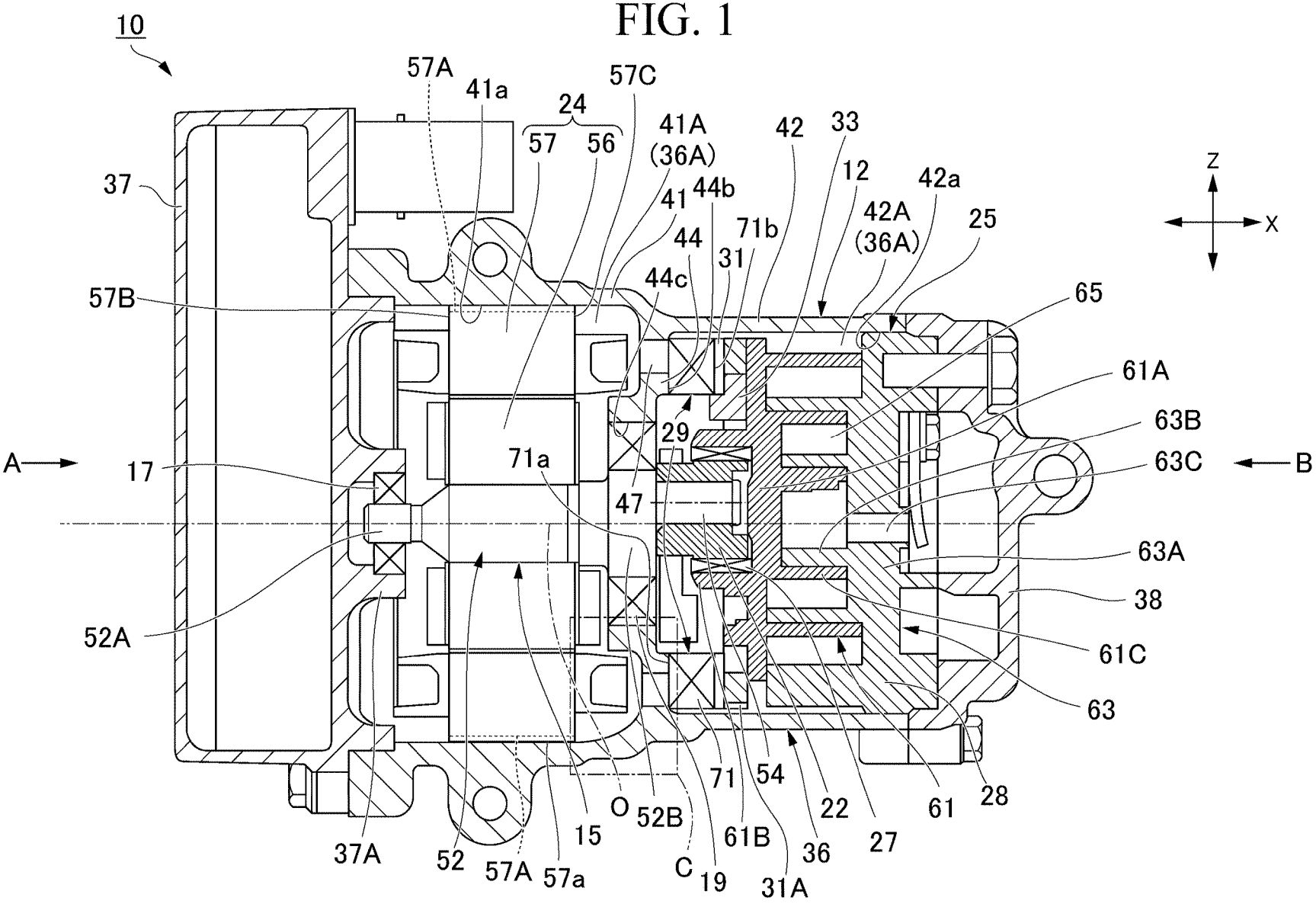
FIG. 1 is a sectional view illustrating a schematic configuration of a scroll compressor according to an embodiment of the present invention.

A scroll compressor 10 according to the embodiment of the present invention will be described with reference to FIG. 1. In FIG. 1, O represents an axis (hereinafter, referred to as an "axis O") of a rotary shaft 15, an X-direction represents an extending direction of the axis O (hereinafter, referred to as a "direction of the axis O") of the rotary shaft 15, and a Z-direction represents a vertical direction perpendicular to the X-direction.

The axis O indicates the axis of the rotary shaft 15 and the axis of a casing 12. The scroll compressor 10 has the casing 12, the rotary shaft 15, radial bearing 17, 19, and 27, a drive bush 22, a motor 24, a scroll compression unit 25, an oil separator (not illustrated), a throttle portion (not illustrated), a thrust bearing 29, a thrust plate 31, and an Oldham ring 33.

Figure 2:
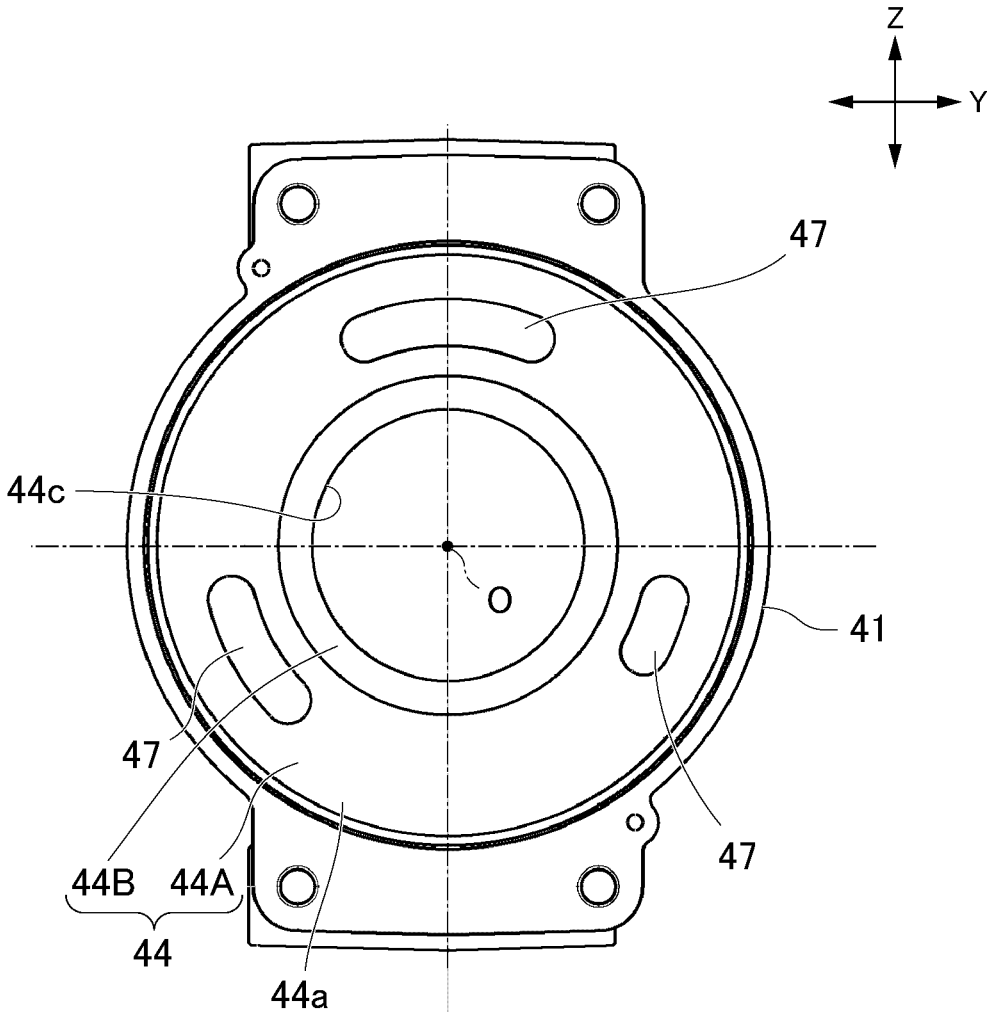
FIG. 2 is a view when a casing body illustrated in FIG. 1 is viewed in a direction of an arrow A.
Figure 3:
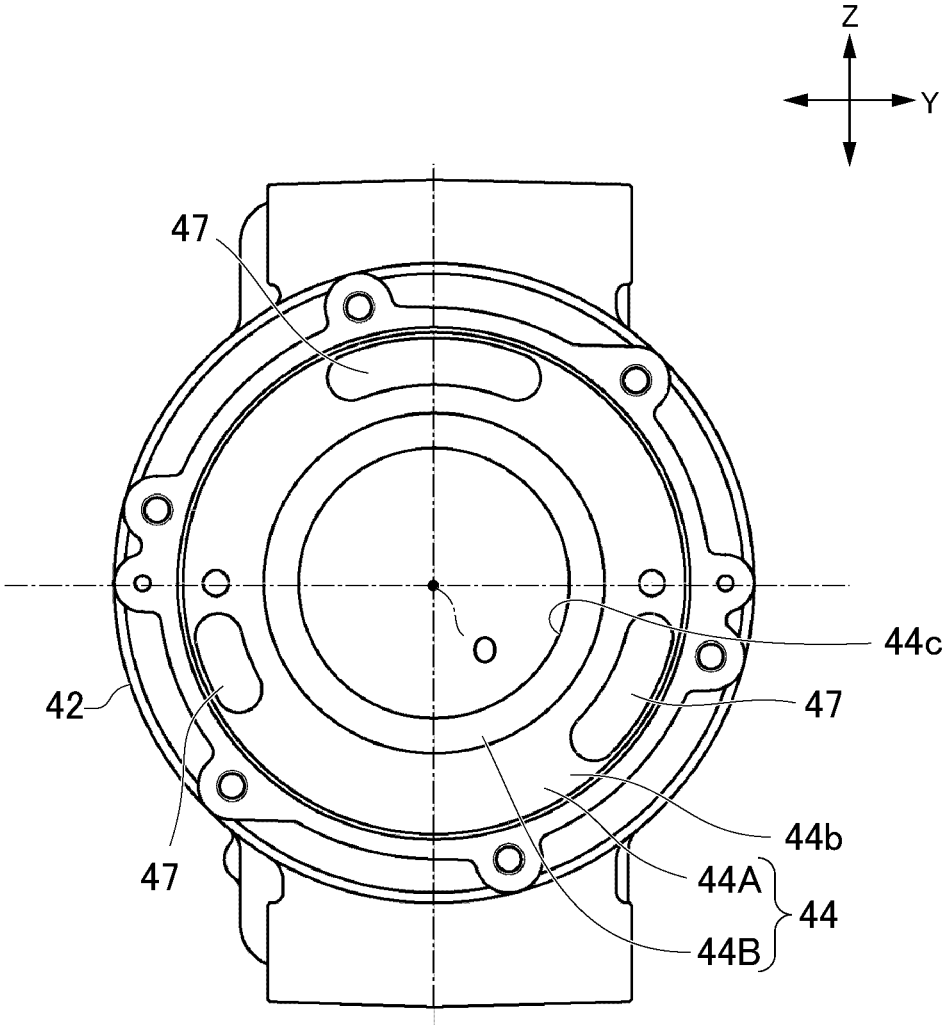
FIG. 3 is a view when the casing body illustrated in FIG. 1 is viewed in a direction of an arrow B.
Figure 4:
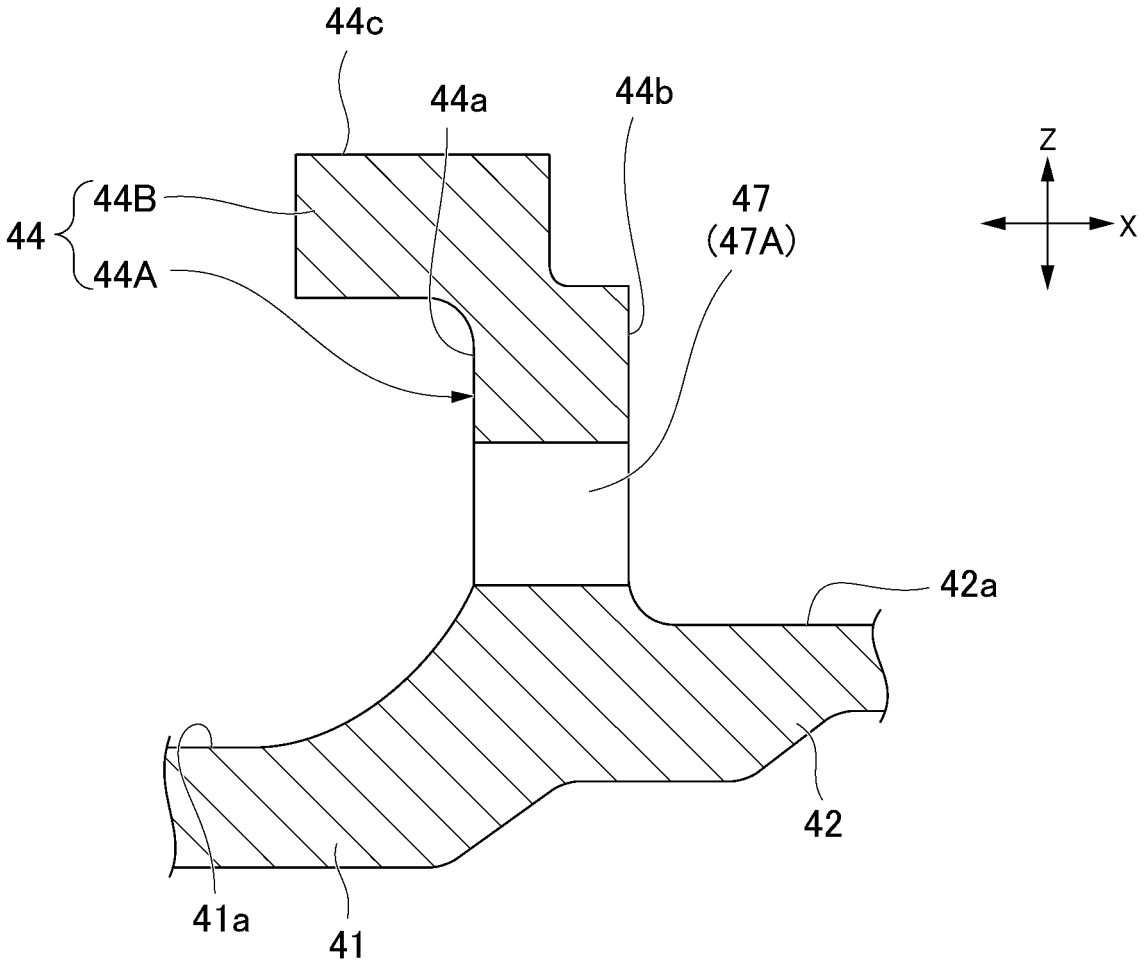
FIG. 4 is an enlarged sectional view illustrating a portion surrounded by a region C in a casing illustrated in FIG. 1.

Next, the casing 12 will be described with reference to FIGS. 1 to 3. A Y-direction illustrated in FIGS. 2 and 3 indicates a direction perpendicular to the X-direction and the Z-direction. In FIGS. 1 to 3, the same reference numerals will be given to the same configuration elements.

The casing 12 has a casing body 36, a first lid 37, a second lid 38, and a bearing holder 44.

The casing body 36 includes a first cylindrical portion 41 and a second cylindrical portion 42. The first cylindrical portion 41 is a member having a cylindrical shape formed around the axis O. Both ends of the first cylindrical portion 41 are open ends.

The first cylindrical portion 41 has an inner peripheral surface 41*a* and a motor housing space 41A. The motor housing space 41A is a columnar space defined by the inner peripheral surface 41*a* of the first cylindrical portion 41 and the bearing holder 44.

The motor 24 is housed in the motor housing space 41A.

A mist-like lubricant and a fluid (working fluid) to be compressed by the scroll compression unit 25 is supplied to the motor housing space 41A from an outside of the casing 12.

The second cylindrical portion 42 is a member having a cylindrical shape formed around the axis O. Both ends of the second cylindrical portion 42 are open ends.

The second cylindrical portion 42 has an inner peripheral surface 42*a* and a compression unit housing space 42A. The compression unit housing space 42A is a columnar space defined by the inner peripheral surface 42*a* of the second cylindrical portion 42 and the bearing holder 44. The scroll compression unit 25 is housed in the compression unit housing space 42A. The compression unit housing space 42A together with the motor housing space 41A configures the housing space 36A.

The bearing holder 44 protrudes inward in a radial direction of the casing 12 from an inner peripheral surface of a boundary portion between the first cylindrical portion 41 and the second cylindrical portion 42. In the bearing holder 44, the housing space 36A is divided into the motor housing space 41A located on one side (one side in an axial direction) in the direction of the axis O and the compression unit housing space 42A located on the other side (other side in the axial direction) in the direction of axis O.

The bearing holder 44 has a first portion 44A including a plurality of flow paths 47, and a second portion 44B.

The first portion 44A extends inward in a circumferential direction from an inner side of the boundary portion between the first cylindrical portion 41 and the second cylindrical portion 42. The first portion 44A is a ring-shaped member.

The first portion 44A has a first surface 44*a*, a second surface 44*b*, and the plurality of flow paths 47. The first surface 44*a* is a surface facing one side (one side in the axial direction) in the direction of the axis O. The second surface 44*b* is a surface facing the other side (other side in the axial direction) in the direction of the axis O.

The plurality of flow paths 47 are disposed at an interval in the circumferential direction of the first portion 44A. One end of the plurality of flow paths 47 is exposed on the first surface 44*a*, and the other end is exposed on the second surface 44*b*. The plurality of flow paths 47 cause the motor housing space 41A and the compression unit housing space 42A to communicate with each other.

The plurality of flow paths 47 may have mutually different widths in the circumferential direction. In this way, the plurality of flow paths 47 are caused to have mutually different widths in the circumferential direction. In this manner, the plurality of flow paths 47 are located to avoid a member located on the second surface 44*b* side of the bearing holder 44.

Each of the plurality of flow paths 47 configured as described above is disposed at a position corresponding to one of the stator groove portions 57A.

In this way, the flow path 47 penetrating the bearing holder 44 in the direction of the axis O is disposed in the portion corresponding to the formation position of the plurality of stator groove portions 57A in the bearing holder 44. In this manner, the fluid and the lubricant which pass through the stator groove portion 57A are likely to be guided to the flow path 47. In this manner, the pressure loss of the fluid can be reduced when the fluid passes through the flow path 47.

The first lid 37 is disposed in the first cylindrical portion 41 so as to block the open end of the first cylindrical portion 41 on a side having no bearing holder 44.

The first lid 37 has a boss portion 37A extending into the motor housing space 41A. The first lid 37 is fixed to the first cylindrical portion 41 by a bolt, for example.

The second lid 38 is disposed in the second cylindrical portion 42 so as to block the open end of the second cylindrical portion 42 on a side having no bearing holder 44. The second lid 38 is fixed to the second cylindrical portion 42 by a bolt, for example.

The rotary shaft 15 is housed inside the casing 12 in a state where the rotary shaft 15 extends in the X-direction. The rotary shaft 15 has a rotary shaft body 52 and an eccentric shaft portion 54. The rotary shaft body 52 has one end portion 52A located on the first lid 37 side and the other end portion 52B located on the second lid 38 side.

The one end portion 52A has a columnar shape. The one end portion 52A has a smaller diameter than a portion excluding the one end portion 52A and the other end portion 52B in the rotary shaft body 52. The one end portion 52A is rotatably supported by the radial bearing 17 disposed on the inner peripheral surface of the boss portion 37A.

The other end portion 52B has a columnar shape. The other end portion 52B has a smaller diameter than the portion excluding the one end portion 52A and the other end portion 52B. The other end portion 52B is rotatably supported by a radial bearing 19 (first radial bearing) disposed on an inner peripheral surface 44*c* of the bearing holder 44.

The eccentric shaft portion 54 is disposed on a side facing the scroll compression unit 25 in the other end portion 52B. The eccentric shaft portion 54 is disposed at a position shifted from the axis O. The eccentric shaft portion 54 extends in the X-direction. The eccentric shaft portion 54 is housed inside the drive bush 22 having a cylindrical shape.

The rotary shaft 15 configured as described above is rotated around the axis O by the motor 24.

The motor 24 has a rotor 56 and a stator 57. The rotor 56 is fixed to an outer peripheral surface of the rotary shaft body 52 located between the one end portion 52A and the other end portion 52B.

Figure 5:
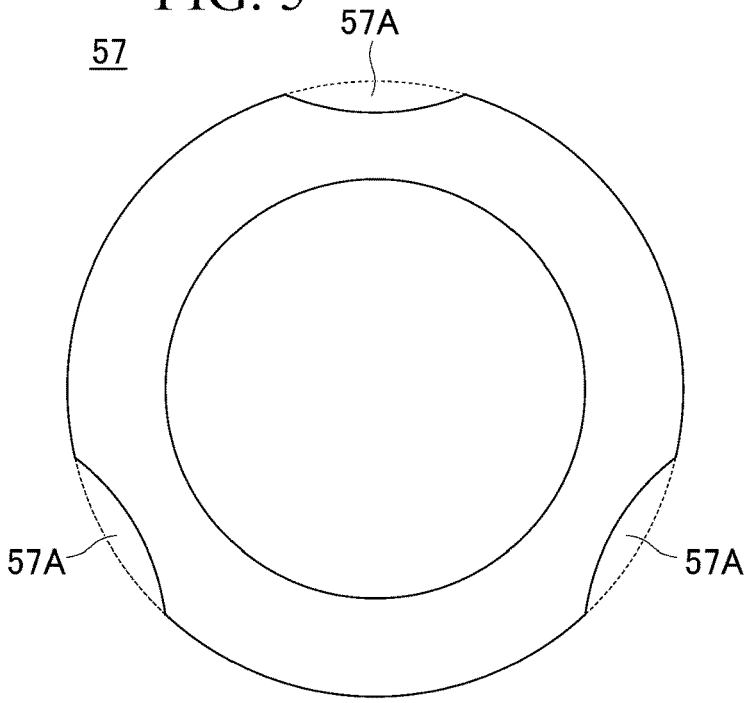
FIG. 5 is a view when a stator illustrated in FIG. 1 is viewed in the direction of the arrow A.

Next, the stator 57 will be described with reference to FIGS. 1 and 5. The stator 57 is located in the motor housing space 41A. The stator 57 has an annular shape formed around the axis O. The outer peripheral surface 57*a* of the stator 57 is fixed to the inner peripheral surface 41*a* of the first cylindrical portion 41 in a state where a gap is interposed therebetween. The stator 57 is located outside of the rotor 56 in the radial direction in a state where a gap is interposed between the stator 57 and the rotor 56.

The stator 57 has a plurality of stator groove portions 57A. The plurality of stator groove portions 57A extend from one end 57B to the other end 57C of the stator 57 in the direction of the axis O.

The plurality of stator groove portions 57A are located at an interval in the circumferential direction of the stator 57.

Referring to FIG. 1, the drive bush 22 is housed inside the boss portion 61B of the turning scroll 61 in a state where the drive bush 22 is fixed to the outer peripheral surface of the eccentric shaft portion 54.

The scroll compression unit 25 is located in the compression unit housing space 42A inside the casing 12. The scroll compression unit 25 has a turning scroll 61 and a fixed scroll 63.

The turning scroll 61 and the fixed scroll 63 are located to face each other in the X-direction.

The turning scroll 61 has an end plate portion 61A, a boss portion 61B, and a spiral portion 61C. The end plate portion 61A faces the end plate portion 63A of the fixed scroll 63 in the X-direction.

The boss portion 61B is disposed on a surface of the end plate portion 61A on a side facing the rotary shaft 15. The boss portion 61B has a cylindrical shape.

The spiral portion 61C is disposed on a surface of the end plate portion 61A on a side facing the fixed scroll 63. The spiral portion 61C extends in a direction toward the fixed scroll 63.

The fixed scroll 63 is fixed to the inside (inner peripheral surface 42*a*) of the casing 12. The fixed scroll 63 has an end plate portion 63A, a spiral portion 63B, and a discharge hole 63C.

The spiral portion 63B is disposed on a surface of the end plate portion 63A on a side facing the turning scroll 61. The spiral portion 63B meshes with the spiral portion 61C. A space 65 for compressing the fluid is formed between the turning scroll 61 and the fixed scroll 63.

The discharge hole 63C is formed to penetrate a central portion of the end plate portion 63A.

The scroll compression unit 25 configured as described above compresses the fluid flowing into the compression unit housing space 42A from the motor housing space 41A, and discharges the compressed fluid from the discharge hole 63C.

A radial bearing 27 (second radial bearing) is disposed between the drive bush 22 and the boss portion 61B.

An oil separator (not illustrated) is installed in the second lid 38 in a state where the lubricant can be supplied to a bottom portion of the compression unit housing space 42A. The oil separator supplies the lubricant to the lubricant supply groove portion 31A of the thrust plate 31 via a throttle portion (not illustrated) installed in a lower portion of the fixed scroll 63.

Figure 6:
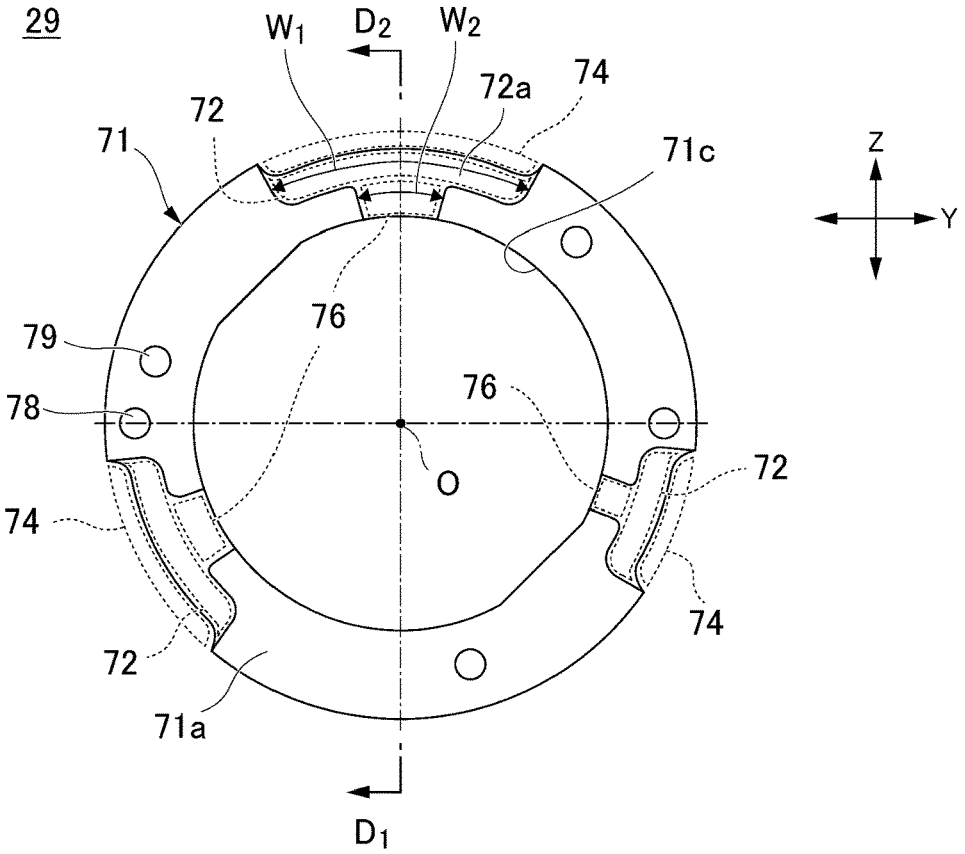
FIG. 6 is a view when a thrust bearing illustrated in FIG. 1 is viewed in the direction of the arrow A.

Next, the thrust bearing 29 will be described with reference to FIGS. 1 to 9. In a structure illustrated in FIGS. 1 to 9, the same reference numerals will be given to the same configuration elements. In FIG. 6, W1 represents a width of the first recess portion 72 in the circumferential direction (hereinafter, referred to as a "width W1"), and W2 represents a width of the second recess portion 76 in the circumferential direction (hereinafter, referred to as a "width W2").

The thrust bearing 29 has a bearing body 71, a first recess portion 72, a first groove portion 74, a second recess portion 76, a plurality of screw holes 78 and 79, an Oldham keyway 81, and an inclined groove portion 83.

The bearing body 71 is an annular member having an annular shape formed around the axis O. The bearing body 71 is located between the bearing holder 44 and the thrust plate 31 in the direction of the axis O. The bearing body 71 has first and second surfaces 71*a* and 71*b* perpendicular to the X-direction.

The first surface 71*a* is in contact with the second surface 44*b* of the bearing holder 44. The second surface 71*b* is a surface located on a side opposite to the first surface 71*a*. The second surface 71*b* is in contact with the thrust plate 31.

The first recess portion 72 is disposed in each portion facing each flow path 47 in the bearing body 71. The first recess portion 72 has a bottom surface 72*a*. The first recess portion 72 is recessed from one side in the direction of the axis O to the other side in the direction of the axis O (in other words, from the first surface 71*a* to the second surface 71*b* side).

In this way, the first recess portion 72 disposed at the position facing each flow path 47 is provided. Accordingly, the fluid and the lubricant which pass through the stator groove portion 57A and the flow path 47 can be retained inside the first recess portion 72.

As an example, FIG. 6 illustrates an example in which three first recess portions 72 are provided. However, the number of the first recess portions 72 can be set as appropriate, and is not limited to three. In addition, a shape and an arrangement of the plurality of first recess portions 72 can be set as appropriate, and are not limited to the structure illustrated in FIG. 6.

The plurality of first groove portions 74 are disposed in the outer peripheral portion of the first recess portion 72. The first groove portion 74 faces a portion of the flow path 47 in the direction of the axis O (refer to FIG. 9).

The first groove portion 74 extends from the bottom surface 72*a* of the first recess portion 72 to the second surface 71*b* in the direction of the axis O. The first groove portion 74 communicates with the first recess portion 72. The first groove portion 74 causes the first recess portion 72 and the compression unit housing space 42A located on the second surface 71*b* side to communicate with each other.

In this way, the bearing body 71 facing the flow path 47 has the first recess portion 72 recessed from the one side in the direction of the axis O to the other side in the direction of the axis O. The outer peripheral portion of the first recess portion 72 has the first groove portion 74 which causes the first recess portion 72 and the compression unit housing space 42A located on the second surface 71*b* side to communicate with each other. In this manner, the lubricant can be properly supplied, and the pressure loss of the fluid can be reduced when the fluid passes through the thrust bearing 29.

In addition, the thrust bearing 29 has the first recess portion 72. In this manner, without increasing a cross section of the flow path of the first groove portion 74, the pressure loss of the fluid can be reduced when the fluid passes through the thrust bearing 29.

The second recess portion 76 is disposed inside each of the three first recess portions 72 which are wide in the circumferential direction in the bearing body 71. The second recess portion 76 communicates with the first recess portion 72, and extends to the inner peripheral surface 71*c* (inner peripheral surface of the thrust bearing 29) of the bearing body 71. In this manner, the second recess portion 76 causes the first recess portion 72 and the compression unit housing space 42A located inside the inner peripheral surface 71*c* to communicate with each other in the radial direction.

Figure 7:
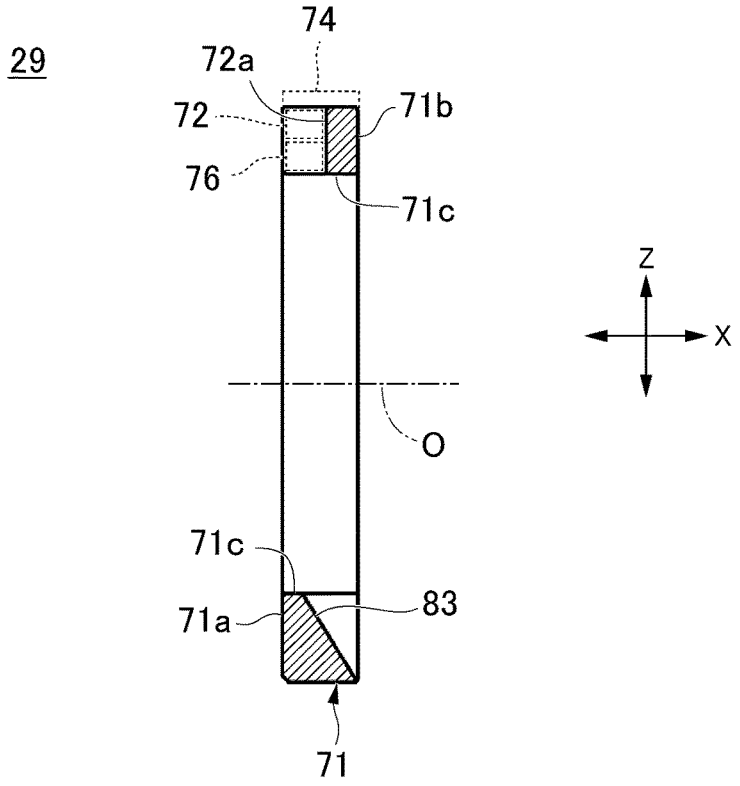
FIG. 7 is a sectional view of the thrust bearing illustrated in FIG. 6, which is taken in a direction of line D1-D2.

For example, as illustrated in FIG. 7, the depth of the second recess portion 76 may be the same as the depth of the first recess portion 72, or may be different from the depth of the first recess portion 72.

The second recess portion 76 configured in this way is provided. Accordingly, the lubricant retained inside the first recess portion 72 can be supplied to the radial bearings 19 and 27 located inside in the radial direction.

For example, it is preferable that the width W2 of the second recess portion 76 in the circumferential direction is narrower than the width W1 of the first recess portion 72 in the circumferential direction.

For example, if the width W2 of the second recess portion 76 in the circumferential direction is wider than the width W1 of the first recess portion 72 in the circumferential direction, a large amount of the fluid and the lubricant is supplied inward in the radial direction of the thrust bearing 29. Therefore, there is a possibility that the compression efficiency may be degraded in the scroll compression unit 25 due to a decrease in the amount of the fluid and the lubricant which are supplied to the scroll compression unit 25 side.

On the other hand, the width W2 of the second recess portion 76 in the circumferential direction is made narrower than the width W1 of the first recess portion 72 in the circumferential direction. In this manner, the lubricant is supplied inward in the radial direction of the thrust bearing 29, and moreover, the compression efficiency can be improved in the scroll compression unit 25.

The plurality of screw holes 78 and 79 are disposed in the bearing body 71 in the circumferential direction. The plural of screw holes 78 and 79 are holes for locating a screw or a bolt to be connected to a member located in the direction of the axis O.

Figure 8:
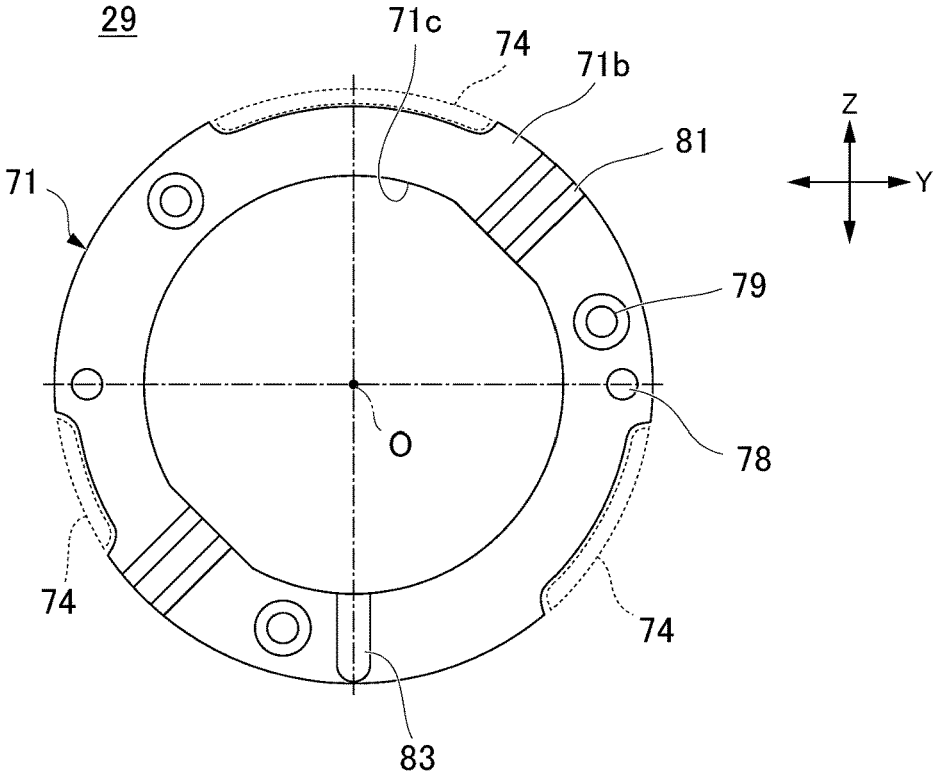
FIG. 8 is a view when the thrust bearing illustrated in FIG. 1 is viewed in the direction of the arrow B.
Figure 9:
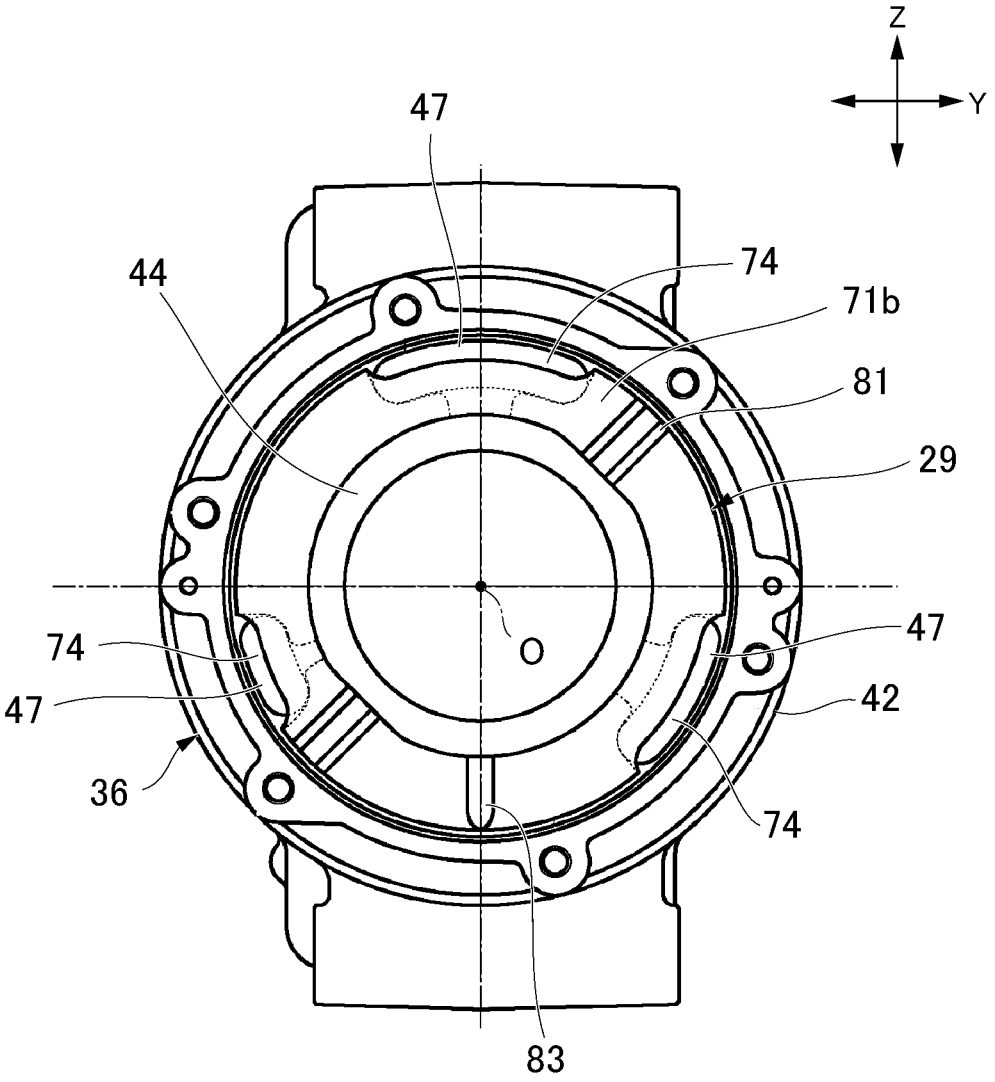
FIG. 9 is a view when a structure having the thrust bearing attached to the casing body illustrated in FIG. 1 is viewed from a compression unit housing space in an axial direction.
Figure 10:
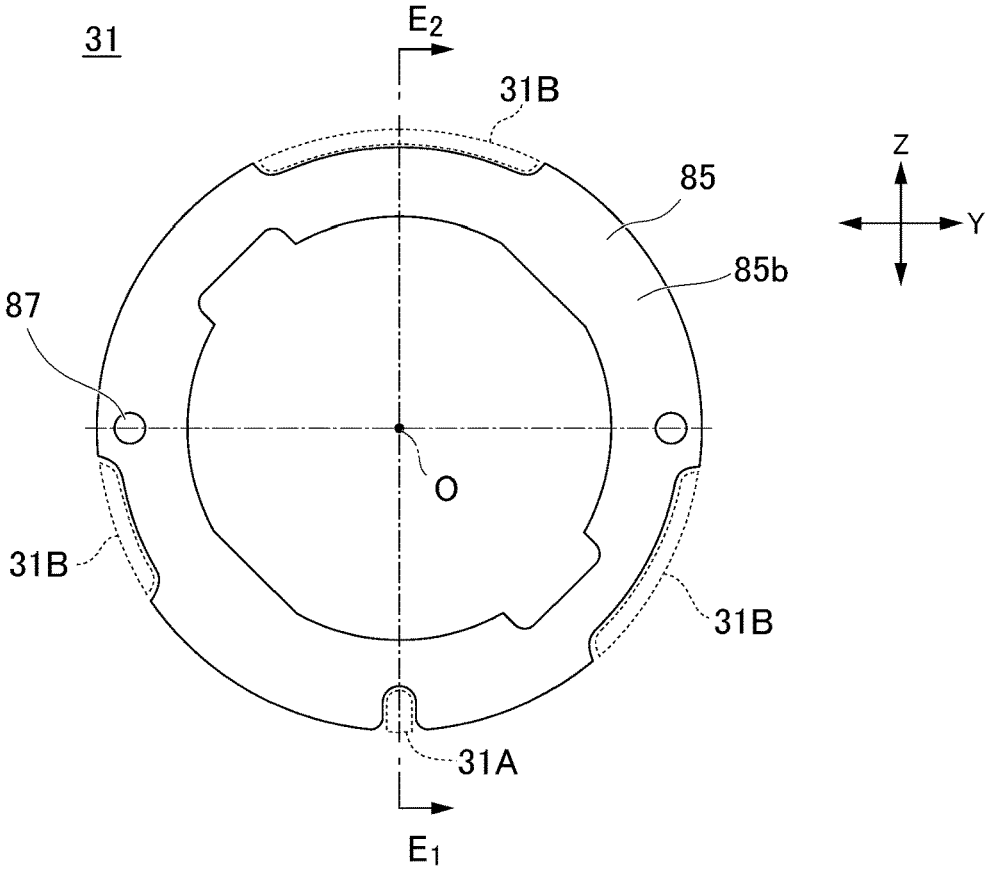
FIG. 10 is a view when a thrust plate illustrated in FIG. 1 is viewed in the direction of the arrow B.
Figure 11:
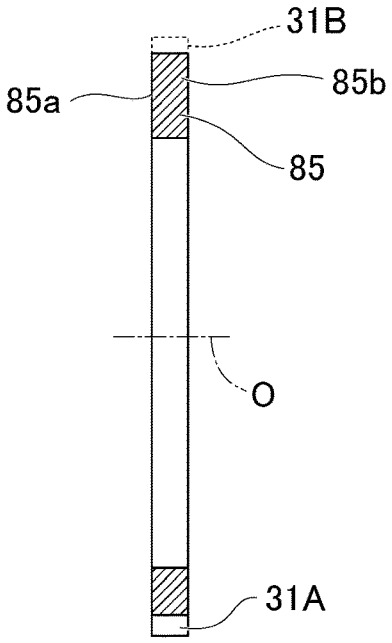
FIG. 11 is a sectional view of the thrust plate illustrated in FIG. 10, which is taken in a direction of line E1-E2.

The number and an arrangement of the plurality of screw holes 78 and 79 illustrated in FIGS. 6 and 8 are merely examples, and the present invention is not limited thereto.

The Oldham keyway 81 is formed on the second surface 71*b* side of the bearing body 71. The Oldham keyway 81 is a groove used when the Oldham ring 33 is mounted on the thrust bearing 29.

The inclined groove portion 83 is disposed in a lower portion (specifically, a lower end portion) of the bearing body 71. The inclined groove portion 83 is formed by cutting out the bearing body 71. The inclined groove portion 83 is inclined in a direction toward the axis O. The lower end portion of the inclined groove portion 83 faces the lubricant supply groove portion 31A disposed in the thrust plate 31 in the direction of the axis O.

The inclined groove portion 83 and the lubricant supply groove portion 31A which are configured in this way are provided. Accordingly, the lubricant to be supplied from the oil separator to the inclined groove portion 83 can be supplied to the radial bearings 19 and 27 located inside in the radial direction of the thrust bearing 29 via the lubricant supply groove portion 31A.

Next, the thrust plate 31 will be described with reference to FIGS. 1 and 10 to 12. In FIGS. 1 to 12, the same reference numerals will be given to the same configuration elements.

The thrust plate 31 is disposed between the thrust bearing 29 and the end plate portion 61A in the direction of the axis O. The thrust plate 31 has a plate body 85, the lubricant supply groove portion 31A, the plurality of second groove portions 31B, and a hole 87.

The plate body 85 is a ring-shaped member. The plate body 85 has one surface 85*a* and the other surface 85*b* which are perpendicular to the X-direction.

The one surface 85*a* is a surface located on the motor housing space 41A side. The one surface 85*a* is in contact with the second surface 71*b* of the bearing body 71.

The other surface 85*b* is a surface located on a side opposite to the one surface 85*a*. The other surface 85*b* is in contact with the end plate portion 61A.

The lubricant supply groove portion 31A is disposed in a lower portion (specifically, a lower end portion) of the plate body 85. The lubricant supply groove portion 31A extends from the one surface 85*a* to the other surface 85*b*. The lubricant supply groove portion 31A is located to face the inclined groove portion 83 in the direction of the axis O. The lubricant supply groove portion 31A guides the lubricant supplied from the oil separator to the inclined groove portion 83.

Figure 12:
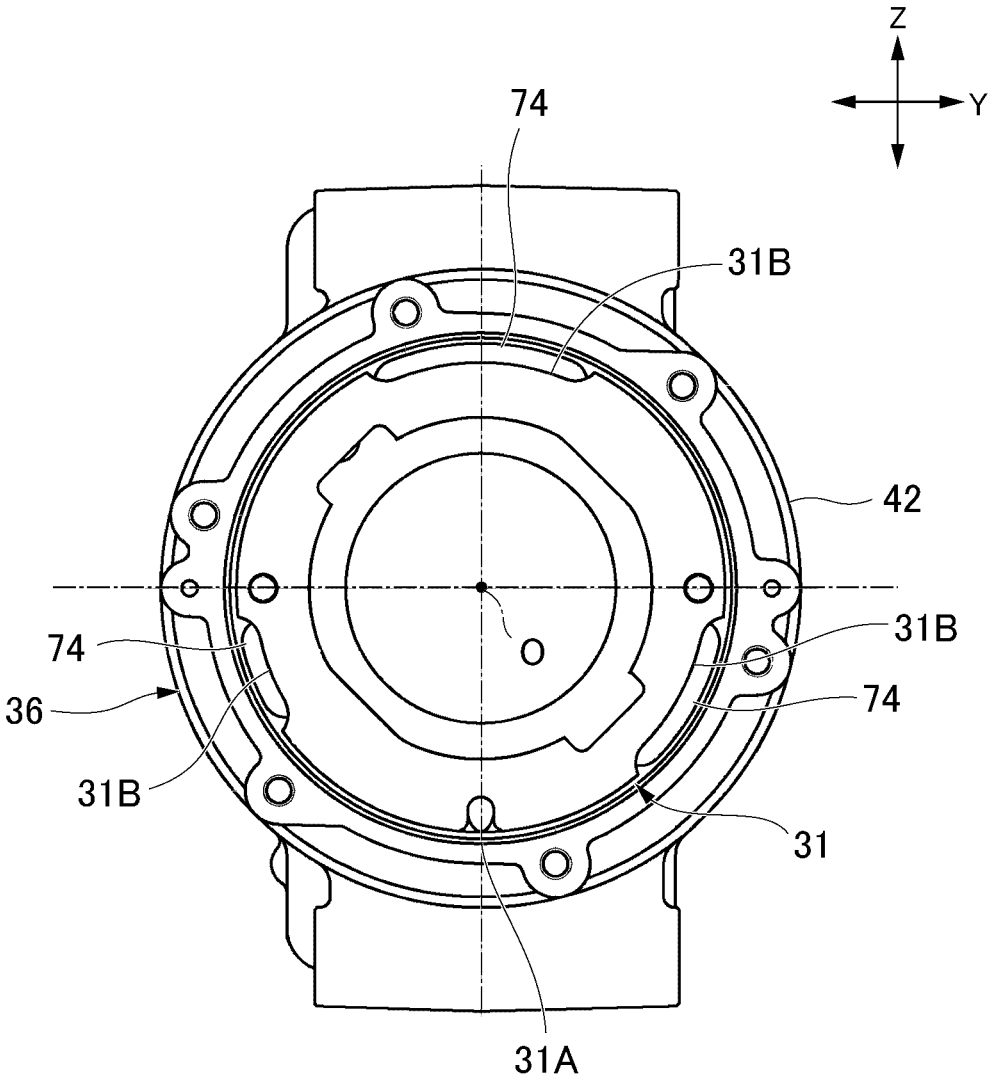
FIG. 12 is a view when a structure having the thrust bearing and the thrust plate which are attached to the casing body illustrated in FIG. 1 is viewed from the compression unit housing space in the axial direction.

The second groove portion 31B is disposed in a portion facing the first groove portion 74 in the outer peripheral portion of the plate body 85 (refer to FIG. 12). The second groove portion 31B is formed to extend from the one surface 85*a* to the other surface 85*b* which are located in the direction of the axis O. In a state where the second groove portion 31B is viewed in the direction of the axis O, the second groove portion 31B has the same shape as the first groove portion 74.

The second groove portion 31B configured in this way is provided. Accordingly, the pressure loss of the fluid can be reduced when the fluid passes through the thrust plate 31.

The plurality (two in a case of FIG. 10 as an example) of the holes 87 are disposed in the plate body 85. The hole 87 is located in a region of the plate body 85 where the lubricant supply groove portion 31A and the second groove portion 31B are not formed.

The hole 87 is a hole for inserting a screw or a bolt used when the thrust plate 31 is fixed to the thrust bearing 29.

Referring to FIG. 1, the Oldham ring 33 is disposed inside the thrust plate 31. A portion of the Oldham ring 33 is located between the thrust bearing 29 and the end plate portion 61A. The Oldham ring 33 is a member for preventing the rotation of the turning scroll 61.

According to the scroll compressor 10 in the present embodiment, each of the flow paths 47 penetrating the bearing holder 44 in the direction of the axis O is disposed in the portion corresponding to the formation position of the plurality of stator groove portions 57A in the bearing holder 44. In this manner, the fluid and the lubricant which pass through the stator groove portion 57A are likely to be guided to the flow path 47. Therefore, the lubricant can be properly supplied, and the pressure loss of the fluid (working fluid) can be reduced when the fluid passes through the flow path 47.

In addition, the first recess portion 72 recessed from one side in the direction of the axis O to the other side in the direction of the axis O is disposed in the portion facing the flow path 47 in the thrust bearing 29. In this manner, the fluid and the lubricant which pass through the flow path 47 can be guided into and retained inside the first recess portion 72.

Furthermore, there is provided the first groove portion 74 disposed in the outer peripheral portion of the first recess portion 72, extending from the bottom surface 72*a* of the first recess portion 72 to the second surface 71*b* in the direction of the axis O, and communicating with the first recess portion 72. In this manner, the pressure loss of the fluid can be reduced when the fluid passes through the thrust bearing 29.

Hitherto, the preferred embodiment according to the present invention has been described in detail. However, the present invention is not limited to the specific embodiment. The present invention can be modified and changed in various ways within the scope of the gist of the present invention disclosed in the appended claims.

INDUSTRIAL APPLICABILITY

The present invention is applicable to a scroll compressor.

REFERENCE SIGNS LIST

10: scroll compressor
12: casing

15: rotary shaft
17, 19, 27: radial bearing
22: drive bush
24: motor
25: scroll compression unit
29: thrust bearing
31: thrust plate
31A: lubricant supply groove portion
31B: second groove portion
33: Oldham ring
36: casing body
36A: housing space
37: first lid
37A, 61B: boss portion
38: second lid
41: first cylindrical portion
41*a*, 42*a*, 42*b*: inner peripheral surface
41A: motor housing space
42: second cylindrical portion
42A: compression unit housing space
44: bearing holder
44*a*, 71*a*: first surface
44*b*, 71*b*: second surface
44*c*, 71*c*: inner peripheral surface
44A: first portion
44B: second portion
47: flow path
52: rotary shaft body
52A: one end portion
52B: other end portion
54: eccentric shaft portion
56: rotor
57: stator
57*a*: outer peripheral surface
57A: stator groove portion
57B: one end
57C: other end
61: turning scroll
61A, 63A: end plate portion
61B: boss portion
61C, 63B: spiral portion
63: fixed scroll
63C: discharge hole
65: space
71: bearing body
72: first recess portion
72*a*: bottom surface
74: first groove portion
76: second recess portion
78, 79: screw hole
81: Oldham keyway
82: hole
83: inclined groove portion
85: plate body
85*a*: one surface
85*b*: other surface
O: axis
W1, W2: hole

The invention claimed is:

1. A scroll compressor comprising:

a casing having a casing body in which a housing space having a columnar shape around an axis is formed, and a bearing holder having an annular shape by protruding inward in a radial direction from an inside of the casing body and which is formed so as to divide the housing space into a motor housing space located on one side in an axial direction and a compression unit housing space located on the other side in the axial direction;

a rotary shaft that is located to extend in the axial direction in the housing space, and that is rotatable around the axis;

a motor that is located in the motor housing space, and having a stator having an annular shape formed around the axis and having an outer peripheral surface fixed to an inner peripheral surface of the casing body, and a rotor located inside the stator and disposed on an outer peripheral surface of the rotary shaft;

a scroll compression unit that is located inside the compression unit housing space, and which is configured to compress a fluid flowing from the motor housing space to the compression unit housing space;

a first radial bearing that is fixed to an inner peripheral surface of the bearing holder, and rotatably supporting the rotary shaft;

a thrust bearing having an annular shape formed around the axis, that is fixed to a surface of the bearing holder facing the other side in the axial direction, and supporting the scroll compression unit in the axial direction; and a thrust plate disposed between the bearing holder and the scroll compression unit in the axial direction, wherein the outer peripheral surface of the stator has a stator groove portion which extends from one end to the other end of the stator in the axial direction, wherein a plurality of the stator groove portions are located at an interval in a circumferential direction of the stator, wherein in the bearing holder, portions corresponding to formation positions of the plurality of stator groove portions each have a flow path penetrating the bearing holder in the axial direction, wherein in the thrust bearing, a portion facing the flow path has a first recess portion recessed from one side in the axial direction to the other side in the axial direction, wherein an outer peripheral portion of the first recess portion has a first groove portion which extends from a bottom surface of the first recess portion to a surface located on a side opposite to a surface having the first recess portion formed thereon in the axial direction and communicates with the first recess portion, and wherein in an outer peripheral portion of the thrust plate, a portion facing the first groove portion has a second groove portion extending from one surface to the other surface, which are located in the axial direction.

2. The scroll compressor according to claim 1, wherein the thrust bearing has a second recess portion disposed inside the first recess portion, communicating with the first recess portion, and extending to an inner peripheral surface of the thrust bearing.

3. The scroll compressor according to claim 2, wherein a width of the second recess portion in a circumferential direction is narrower than a width of the first recess portion in the circumferential direction.

4. The scroll compressor according to claim 1, further comprising:

an oil separator disposed in the casing, wherein a lower portion of the thrust plate has a lubricant supply groove portion which guides a lubricant supplied from the oil separator to the thrust bearing, and wherein a lower portion of the thrust bearing facing the lubricant supply groove portion has an inclined groove portion which guides the lubricant to flow inward in the radial direction.

5. The scroll compressor according to claim 1, wherein the rotary shaft has an eccentric shaft portion extending to the compression unit housing space, and wherein the scroll compressor further comprises a fixed scroll fixed to an inner peripheral surface of the casing, a turning scroll located between the fixed scroll and the eccentric shaft portion, extending in the axial direction, and including a boss portion surrounding the eccentric shaft portion, a drive bush disposed on an outer peripheral surface of the eccentric shaft portion, and partially located inside the boss portion, and a second radial bearing disposed between the drive bush and the boss portion.

* * * * *